US012369634B2

(12) United States Patent
Wu et al.

(10) Patent No.: US 12,369,634 B2
(45) Date of Patent: Jul. 29, 2025

(54) AEROSOL GENERATING DEVICE

(71) Applicant: SHENZHEN FIRST UNION TECHNOLOGY CO., LTD., Shenzhen (CN)

(72) Inventors: Tao Wu, Shenzhen (CN); Zhongli Xu, Shenzhen (CN); Yonghai Li, Shenzhen (CN)

(73) Assignee: SHENZHEN FIRST UNION TECHNOLOGY CO., LTD., Shenzhen (CN)

( * ) Notice: Subject to any disclaimer, the term of this patent is extended or adjusted under 35 U.S.C. 154(b) by 481 days.

(21) Appl. No.: 17/686,496

(22) Filed: Mar. 4, 2022

(65) Prior Publication Data

US 2022/0183365 A1 Jun. 16, 2022

Related U.S. Application Data

(63) Continuation of application No. PCT/CN2020/113582, filed on Sep. 4, 2020.

(30) Foreign Application Priority Data

Sep. 5, 2019 (CN) ..... 201910834914.0

(51) Int. Cl.
*A24F 40/46* (2020.01)
*A24F 40/20* (2020.01)

(52) U.S. Cl.
CPC ..... *A24F 40/46* (2020.01); *A24F 40/20* (2020.01)

(58) Field of Classification Search
None
See application file for complete search history.

(56) References Cited

U.S. PATENT DOCUMENTS

| | | | | |
|---|---|---|---|---|
| 5,665,262 | A * | 9/1997 | Hajaligol | A24F 40/46 131/194 |
| 6,053,176 | A * | 4/2000 | Adams | A24F 40/53 131/329 |
| 10,617,149 | B2 | 4/2020 | Malgat et al. | |
| 11,039,646 | B2 | 6/2021 | Thorsen et al. | |
| 11,819,057 | B2 | 11/2023 | Doyle | |
| 2006/0037619 | A1 * | 2/2006 | Ishikawa | A24C 5/3418 131/280 |
| 2007/0023056 | A1 | 2/2007 | Cantrell et al. | |

(Continued)

FOREIGN PATENT DOCUMENTS

| | | | |
|---|---|---|---|
| CN | 203860264 | U | 10/2014 |
| CN | 107373777 | A | 11/2017 |

(Continued)

*Primary Examiner* — Philip Y Louie
*Assistant Examiner* — Nicole A Szumigalski
(74) *Attorney, Agent, or Firm* — IPRO, PLLC

(57) ABSTRACT

The present application provides an aerosol generating device, which comprises: a chamber, configured to receive a smokable material and maintain a gap with an outer sidewall of the smokable material; a heating element, configured to heat the smokable material removably received in the chamber when in use; at least one spacer, at least partially extending into the gap, so as to prevent air in the chamber from escaping from the chamber through the gap, or prevent the air in the gap from entering the smokable material through an end of the smokable material received in the chamber.

15 Claims, 8 Drawing Sheets

(56) References Cited

U.S. PATENT DOCUMENTS

| | | | | |
|---|---|---|---|---|
| 2016/0331032 | A1* | 11/2016 | Malgat | A24F 40/465 |
| 2017/0188633 | A1 | 7/2017 | Force | |
| 2018/0310617 | A1 | 11/2018 | Ding | |
| 2020/0268047 | A1 | 8/2020 | Doyle | |
| 2020/0375249 | A1 | 12/2020 | Yanez | |
| 2021/0137163 | A1 | 5/2021 | An | |
| 2023/0354884 | A1* | 11/2023 | Jeong | A24F 40/30 |

FOREIGN PATENT DOCUMENTS

| | | | | | |
|---|---|---|---|---|---|
| CN | 107495481 | | * | 12/2017 | |
| CN | 107495481 | A | | 12/2017 | |
| CN | 207653598 | U | | 7/2018 | |
| CN | 207721220 | U | | 8/2018 | |
| CN | 208446615 | U | | 2/2019 | |
| CN | 209185760 | U | | 8/2019 | |
| WO | 2019081602 | A | | 5/2019 | |
| WO | 2019164135 | A | | 8/2019 | |
| WO | WO-2019164135 | A1 | * | 8/2019 | A24F 40/40 |
| WO | WO-2020153830 | A1 | * | 7/2020 | A24F 40/50 |

* cited by examiner

AEROSOL GENERATING DEVICE

CROSS-REFERENCE TO RELATED APPLICATIONS

This application is a continuation-application of International (PCT) Patent Application No. PCT/CN2020/113582, filed on Sep. 4, 2020, which claims priority to Chinese Patent Application No. 201910834914.0, filed with the National Intellectual Property Administration of China on Sep. 5, 2019, and entitled "AEROSOL GENERATING DEVICE", the entire contents of which are incorporated herein by reference.

TECHNICAL FIELD

Embodiments of the present application relate to the field of heat-not-burning smoking sets, and in particular, relate to an aerosol generating device.

BACKGROUND

Tobacco products (e.g., cigarettes, cigars, etc.) burn tobacco to produce tobacco smoke during use. People have attempted to replace these tobacco-burning products by making products that release compounds without burning.

Examples of such products are heating devices that release compounds by heating rather than burning materials. For example, the materials may be tobacco or other non-tobacco products, and the non-tobacco products may or may not contain nicotine. As another example, there are aerosol providing products, such as a so-called low-temperature baking smoking set. A known low-temperature baking smoking set usually comprises a heating cavity for receiving and heating tobacco products. When the tobacco products are received and heated in the heating cavity, aerosol for smoking is generated. However, the outer wrapping paper of the tobacco products will be gelatinized when it is heated, and the gelatinized substances will escape from the heating cavity, which affects the smoking experience of users.

SUMMARY

An embodiment of the present application provides an aerosol generating device, which is configured to heat a smokable material to volatilize at least one component of the smokable material, and comprises: a chamber, configured to receive the smokable material and maintain a gap with an outer sidewall of the smokable material; a heating element, configured to heat the smokable material received in the chamber; and at least one spacer, at least partially extending into the chamber at least when the smokable material is received in the chamber, so as to prevent air in the gap from escaping from the chamber when the heating element heats the smokable material, or prevent the air in the gap from entering the smokable material through an end of the smokable material received in the chamber when the heating element heats the smokable material.

BRIEF DESCRIPTION OF THE DRAWINGS

In order to more clearly illustrate technical solutions in embodiments of the present application, attached drawings required in the description of the embodiments will be briefly introduced hereinafter. Obviously, the attached drawings in the following description are only some embodiments of the present application. For those of ordinary skill in the art, other attached drawings can be obtained according to the structures shown in these drawings without creative labors.

DETAILED DESCRIPTION

In order to facilitate the understanding of the present application, the application will be described in more detail below with reference to the attached drawings and specific embodiments. It shall be noted that, when an element is expressed as "fixed to"/"fixedly connected to" another element, it may be directly on another element, or there may be one or more intermediate elements therebetween. When an element is expressed as "connected" to another element, it may be directly connected to another element, or there may be one or more intervening elements therebetween. Terms such as "vertical", "horizontal", "left", "right", "inside", "outside" and similar expressions used in this specification are used for illustrative purposes only.

Unless otherwise defined, all technical and scientific terms used in this specification have the same meanings as those commonly understood by those skilled in the art of the present application. Terms used in the specification of the present application are only for the purpose of describing specific embodiments, and are not used to limit the present application. The term "and/or" used in this specification comprises any and all combinations of one or more associated listed items.

In addition, technical features involved in different embodiments of the present application described below may be combined with each other as long as they do not conflict with each other.

In this specification, the "installation" comprises fixing or restricting a certain element or device to a specific position or place by means of welding, screwing, clamping, bonding or the like. The element or device may remain stationary at the specific position or place or move within a limited range, and the element or device can or cannot be disassembled after being fixed or restricted to the specific position or place, which is not limited in the embodiments of the present application.

Figure 1:
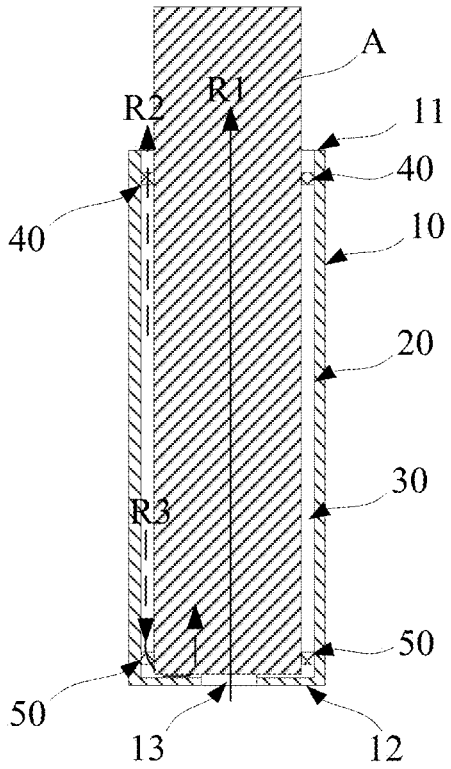
FIG. 1 is a schematic view of an aerosol generating device provided by an embodiment.
Figure 2:
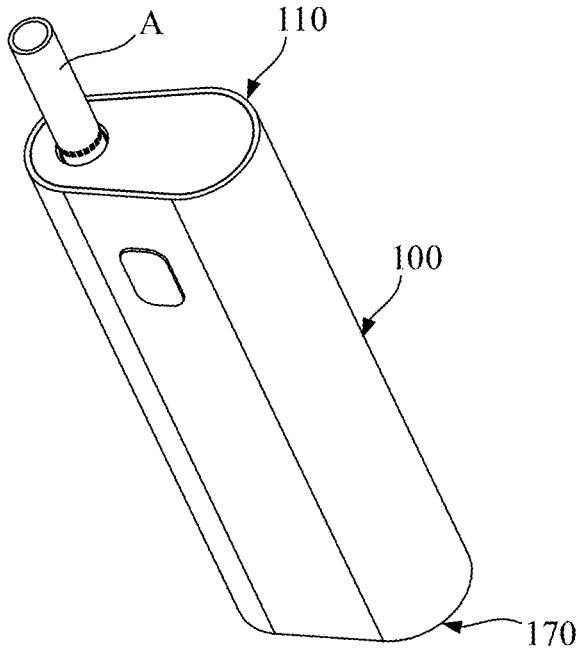
FIG. 2 is a schematic view of an aerosol generating device provided by another embodiment.
Figure 3:
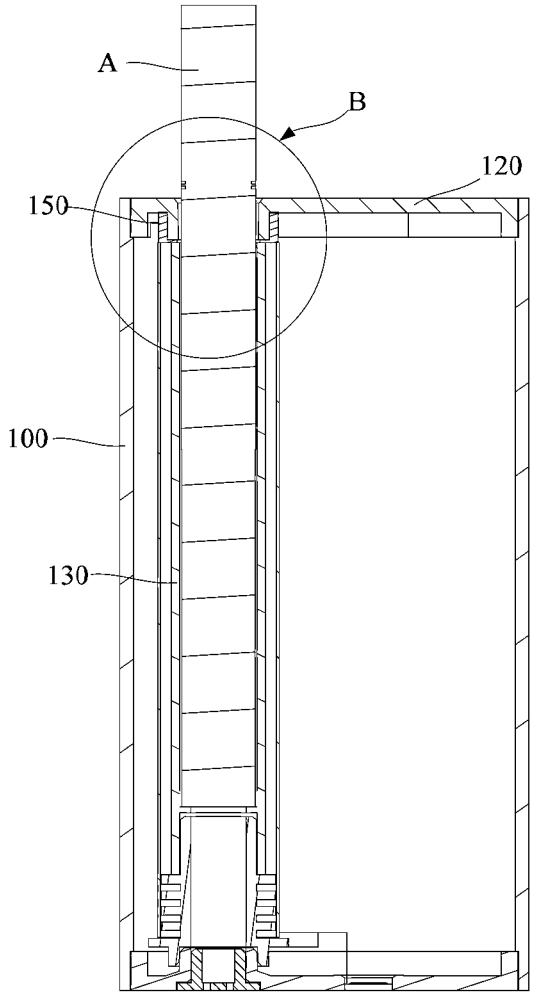
FIG. 3 is a schematic sectional view of the structure of the aerosol generating device shown in FIG. 2.

An embodiment of the present application provides an aerosol generating device, which is used to heat a smokable material to release at least one volatile compound from the smokable material. The structure of the aerosol generating device of this embodiment is shown in FIG. 1, and the aerosol generating device comprises: an outer housing 10, serving as a housing component of the device and accommodating and installing various functional structures inside; and the outer housing 10 has a proximal end 11 and a distal end 12 opposite to each other; wherein the proximal end 11 is configured as an end for the user to install and remove the smokable material A and smoke, while the distal end 12 is the other end away from the user; and a chamber 20, used for receiving and heating at least a part of the smokable material A.

Of course, the inner diameter of the chamber 20 is larger than the outer diameter of the smokable material A in order to facilitate the smooth receiving and removing operations of the smokable material A in the chamber 20; when the smokable material A is inserted into the chamber 20, there is a certain gap 30 between the inner surface of the chamber 20 and the outer surface of the smokable material A.

In order to facilitate the smooth circulation of airflow during smoking, an air inlet 13 is provided on the distal end 12 to allow external air to enter the outer housing 10 during smoking. During smoking, the airflow circulation path is shown by an arrow R1 in FIG. 1, the external air enters the chamber 20 from the air inlet 13 and passes through the smokable material A until it is smoked by the user.

Further, the aerosol generating device is further provided with a first spacer 40 for preventing the air in the chamber 20 from leaving the chamber 20 through the gap 30. Furthermore, it can be seen from the embodiment shown in FIG. 1 that the first spacer 40 is filled in the gap 30 and is located near the proximal end 11, and it is arranged around a part of the outer surface of the smokable material A so as to prevent the air in the gap 30 from leaving the chamber 20 in the way indicated by an arrow R2 in FIG. 1.

Furthermore, the aerosol generating device is also provided with a second spacer 50, the second spacer 50 is filled in the gap 30 and is located near the distal end 12, and it is used for preventing the air in the gap 30 from entering the smokable material A from the end of the smokable material A opposite to the distal end 12 in the way indicated by an arrow R3 in FIG. 1.

The present application further provides an aerosol generating device according to another embodiment, and the structure thereof is shown in FIG. 2 to FIG. 5, and the aerosol generating device comprises: an outer housing 100, installed with various functional components inside, having a proximal end 110 and a distal end 170 opposite to each other; an end cap 120, disposed at the proximal end 110 of the outer housing 100; a heating pipe 130, disposed in the outer housing 100; a cavity 140 in the heating pipe 130 is used to receive at least a part of the smokable material A.

Figure 4:
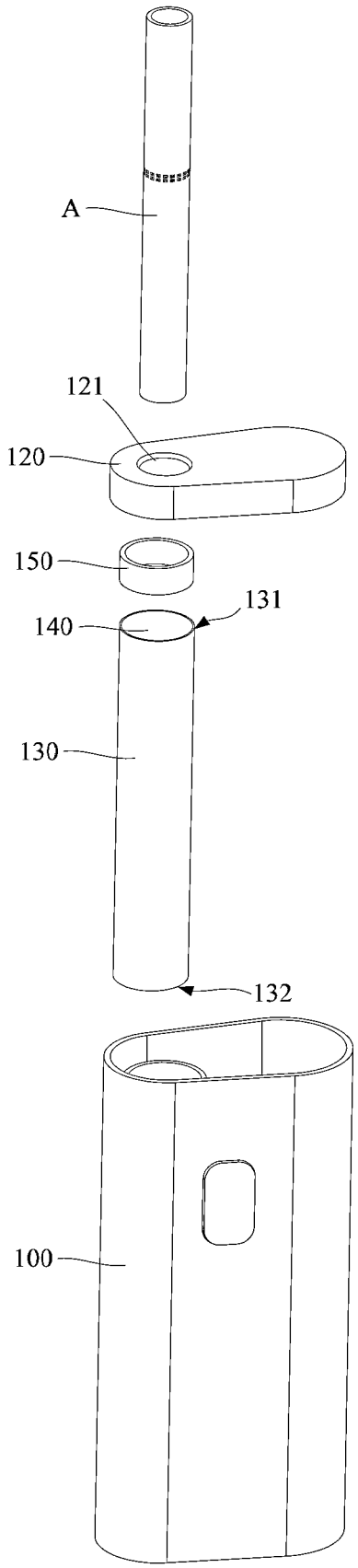
FIG. 4 is a schematic exploded view of the structure of the aerosol generating device shown in FIG. 3.

It can also be seen from FIG. 4 that, the end cap 120 is provided with an opening 121 thereon, and the position of the opening 121 is opposite to the cavity 140 of the heating pipe 130, so that the smokable material A can be at least partially received in the cavity 140 or removed from the cavity 140 through the opening 121.

Figure 5:
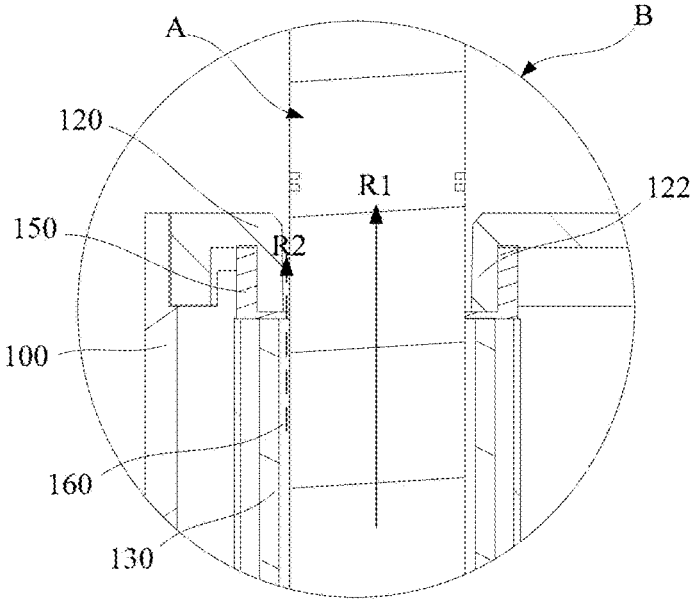
FIG. 5 is an enlarged schematic view of a part B in FIG. 3.

In the embodiment shown in FIG. 4 and FIG. 5, the heating pipe 130 comprises a first end 131, a second end 132 and a hollow central portion, the hollow central portion forms the cavity 140, and the cavity 140 and the opening 121 form the chamber of the aerosol generating device for receiving the smokable material A. In practice, the distal end 170 of the outer housing 100 is provided thereon with an air inlet (not labeled in the figure) opposite to the second end 132, which is used to take air into the cavity 140 when the user smokes.

Further, the outer housing 100 is further provided therein with a spacer 150, the spacer 150 is used for airflow isolation and prevents the air in the cavity 140 from leaving the outer housing 100 in a way other than passing through the smokable material A. The spacer 150 is arranged at the first end 131, which may prevent the air in the cavity 140 from escaping from the gap 160 between the inner surface of the heating pipe 130 and the outer sidewall of the smokable material A as shown by the arrow R2 in FIG. 5 until it leaves the outer housing 100. Therefore, it is ensured that during smoking, the volatile substances generated by the smokable material A after being heated can only leave the outer housing 100 through pores inside the smokable material A according to the arrow R1 in FIG. 5, until they are filtered by the filter at the top of the smokable material A and smoked by the user.

Figure 6:
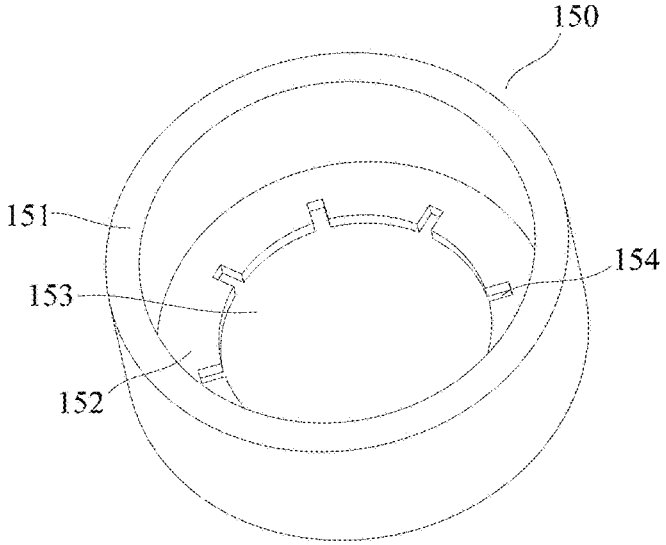
FIG. 6 is a schematic structural diagram of a spacer in FIG. 3 to FIG. 5.

Based on the embodiment of FIG. 5 and FIG. 6, the spacer 150 mainly comprises a ring-shaped mounting part 151 which is convenient for mounting, and a blocking part 152 extending from the mounting part 151. Of course, based on function realization, the blocking part 152 is ring-shaped and has a through hole 153 through which the smokable material A passes, so that the smokable material A is smoothly received in or removed from the cavity 140. Furthermore, when the smokable material A is received in the cavity 140, the blocking part 152 abuts against the outer surface of the smokable material A, thereby realizing air isolation and preventing the air in the cavity 140 from escaping.

In the embodiments, if the diameter of the through hole 153 is smaller than the outer diameter of the smokable material A, it may be beneficial to maintain the isolation effect. In practice, the size of the diameter of the through hole 153 may be preferably designed according to the interference effect of 0.1 mm to 0.5 mm. Of course, based on the optimized airtightness isolation effect, the spacer 150 is made of flexible materials, such as silica gel, flexible resin or the like.

Further, according to the embodiment shown in FIG. 5 and FIG. 6, the end cap 120 is provided thereon with a flange 122 extending toward the heating pipe 130, and the mounting part 151 is annularly sleeved on the flange 122 for mounting and fixing. In addition, the blocking part 152 is provided thereon with a notch 154 extending along the radial direction of the through hole 153, which makes the blocking part 152 more deformable and easier to deform, and reduces the friction force between the smokable material A and the blocking part 152, thus facilitating the insertion or removal operations of the smokable material A. Of course, based on the similar effect of reducing the rigidity strength of the blocking part 152, the notch 154 may also be implemented with a similar slit structure or the like. At the same time, the width of the notch 154 or the slit is controlled to be 0.05 mm to 1 mm in practice, and at the same time, the notch 154 or the slit has an appropriate airtightness effect.

Figure 7:
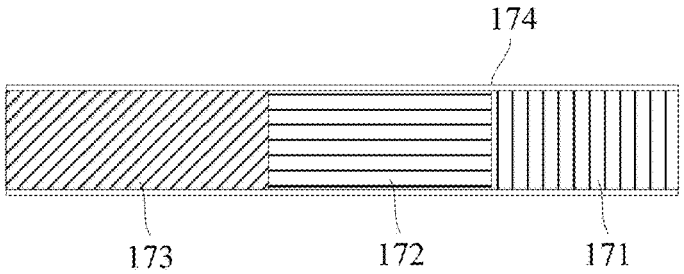
FIG. 7 is a schematic structural diagram of a smokable material provided by an embodiment.

In an embodiment, the smokable material A comprises a specially-made cylindrical cigarette, specifically as shown in FIG. 7, and comprises a filter 171, a cooling filler 172, a tobacco material 173, and an outer wrapping paper 174 which are axially assembled in sequence along the axial direction. The tobacco material 173 releases volatile substances when heated, and the volatile substances are smoked after being cooled and filtered by the cooling filler 172 and the filter 171. In an embodiment, the outer wrapping paper 174 is made of hemp pulp mixed with partially bleached wood pulp or straw pulp as the raw material, and after high viscosity beating and adding fillers (such as calcium carbonate), the outer wrapping paper 174 is made by being pressed with a watermark roller on a paper machine or a dry roller outside the machine.

In an embodiment, the above heating pipe 130 may be directly made of materials with appropriate resistivity, and after being connected with a power supply (not shown in the figure) through conductive structures such as leads, pins and conductive terminals, the heating pipe 130 is powered by the power supply to heat the smokable material A. Suitable materials may comprise pure nickel alloy, nickel-chromium alloy, nickel-iron alloy, iron-chromium alloy, iron-chromium aluminum alloy, titanium alloy or stainless steel or the like.

Figure 8:
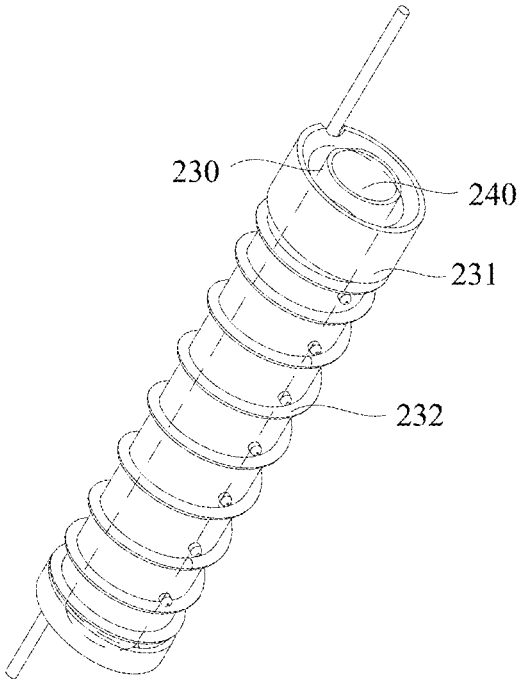
FIG. 8 is a schematic structural diagram of a heating assembly in an aerosol generating device according to another embodiment.

In another embodiment, the structure of the heating part of the aerosol generating device may be shown in FIG. 8, the heating part comprises a tubular susceptor 230, and the hollow portion in the tubular susceptor 230 forms a cavity 240 for containing the smokable material A; a tubular support 231 is nested outside the tubular susceptor 230, and an electromagnetic coil 232 is wound around the tubular support 231. The electromagnetic coil 232 is used to generate a changing magnetic field, and the tubular susceptor 230 is made of a material with appropriate magnetic permeability and it may generate heat when penetrated by the changing magnetic field, so as to heat the smokable material A contained inside.

Figure 9:
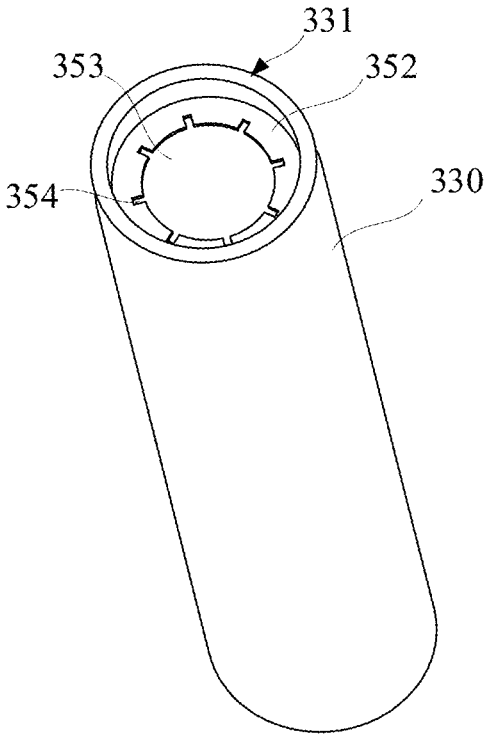
FIG. 9 is a schematic structural diagram of a heating pipe in an aerosol generating device according to another embodiment.

In another embodiment of the present application, the aerosol generating device uses the heating pipe 330 shown in FIG. 9 to heat the smokable material A. The heating pipe 330 is provided therein with a blocking part 352 extending from the inner wall into the hollow cavity, and the blocking part 352 is close to the first end 331 for abutting against the outer surface of the smokable material A to prevent the air in the heating pipe 330 from escaping from the first end 331. Similarly, the blocking part 352 has a through hole 353 through which the smokable material A passes, and a notch 354 extending in the radial direction, so as to reduce the friction coefficient between the smokable material A and the blocking part 352, thereby facilitating the insertion or removal operations of the smokable material A.

Of course, in other modified embodiments, the blocking part 352 may be arranged in the opening 121 of the end cap 120 similar to that of FIG. 4, and is integrally arranged with the end cap 120 as a part of the end cap 120.

The present application further provides an aerosol generating device of another embodiment. The structure of the aerosol generating device of this embodiment is shown in FIG. 10, and the aerosol generating device comprises: an outer housing 410; a heating pipe 430, inside which a cavity for receiving and heating the smokable material A is formed, and there is a certain gap 440 between the smokable material A and the inner wall of the heating pipe 430; a spacer 450, arranged near a second end 432, and configured to prevent the air in the gap 440 from entering the smokable material A from the end of the smokable material A opposite to the second end 432 as shown by the arrow R3; thereby ensuring that only external air can enter the smokable material A according to the path indicated by an arrow R1 in FIG. 10 during smoking.

Figure 10:
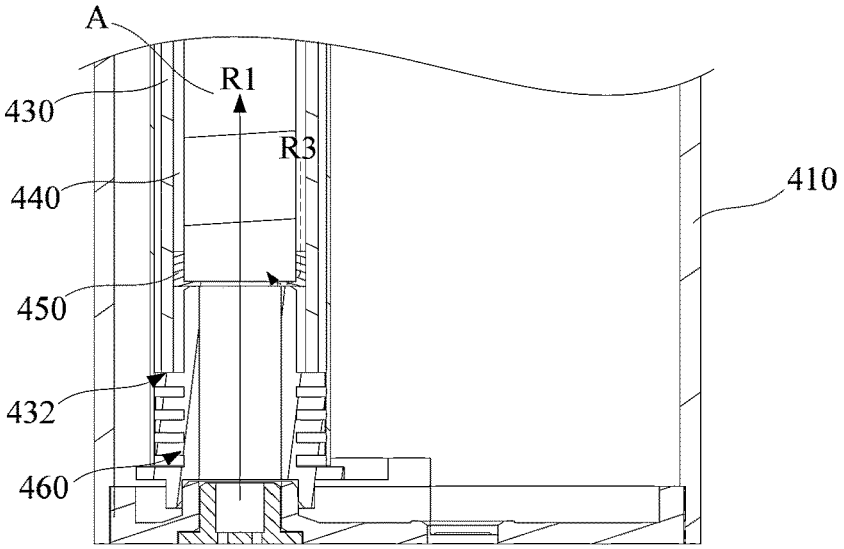
FIG. 10 is a schematic structural diagram of an aerosol generating device according to another embodiment.
Figure 11:
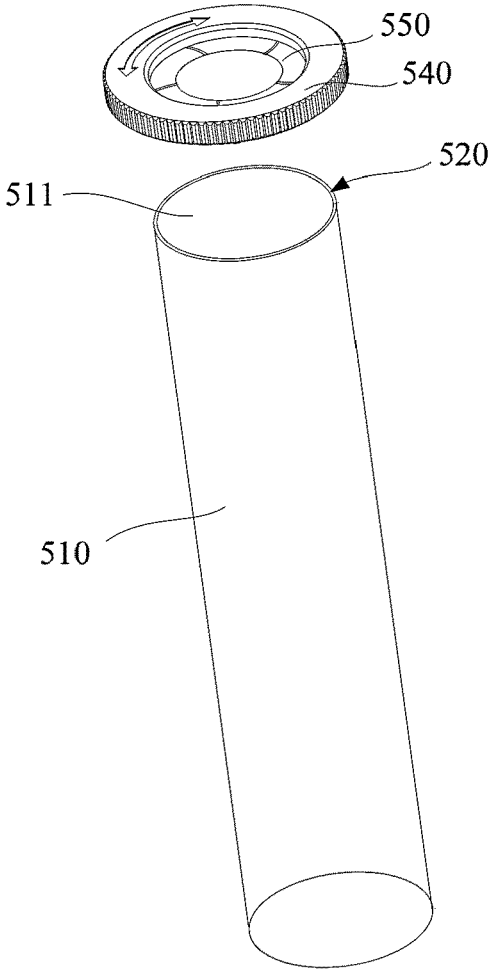
FIG. 11 is a schematic structural diagram of an aerosol generating device according to another embodiment.

Of course, it can also be seen from FIG. 10 that in order to ensure that the smokable material A can be fixed and maintained after being received in the heating pipe 430, a material support frame 460, which is preferably made of temperature-resistant material such as temperature-resistant plastic, is further provided in the outer housing 410, and it at least partially extends into the heating pipe 430. When the smokable material A is received in the heating pipe 430, it abuts on the material support frame 460 to remain fixed.

In an aerosol generating device of another embodiment, an isolation structure that may be manually or automatically operated by a user is also proposed, as shown in FIG. 11 to FIG. 14. In the structure shown in FIG. 11 to FIG. 14, there is a tubular heating element 510, and the space in the tubular heating element 510 forms an accommodating cavity 511 for receiving the smokable material A such as cigarettes. Of course, the tubular heating element 510 is assembled in the outer housing (not shown in the figure) of the aerosol generating device.

Further, the tubular heating element 510 has an open end 520 through which the smokable material A can be received into or removed from the accommodating cavity 511. At least one movable spacer 550 is provided at the open end 520, and the spacer 550 may be actuated manually or electrically by a user to move. Therefore, when the smokable material A is received and heated in the accommodating cavity 511, it is possible to prevent the air in the gap between the outer sidewall of the smokable material A and the accommodating cavity 511 from escaping by moving the spacer 550 to be around the outer periphery of the smokable material A and moderately abut against the outer sidewall of the smokable material A.

After completing the smoking, in order to facilitate the removal of the smokable material A, the spacer 550 may be further driven to move, so that it can move away from the outer sidewall of the smokable material A to release the smokable material A, thereby facilitating the removal operation of the smokable material A. The states are shown in FIG. 13 and FIG. 14 respectively.

Figure 12:
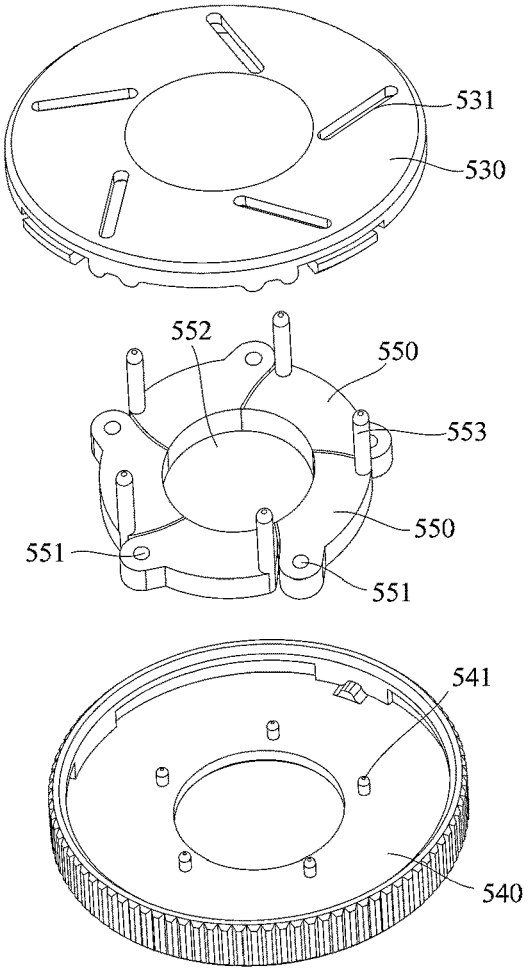
FIG. 12 is a schematic view of a component driving the spacer to move in FIG. 11.
Figure 13:
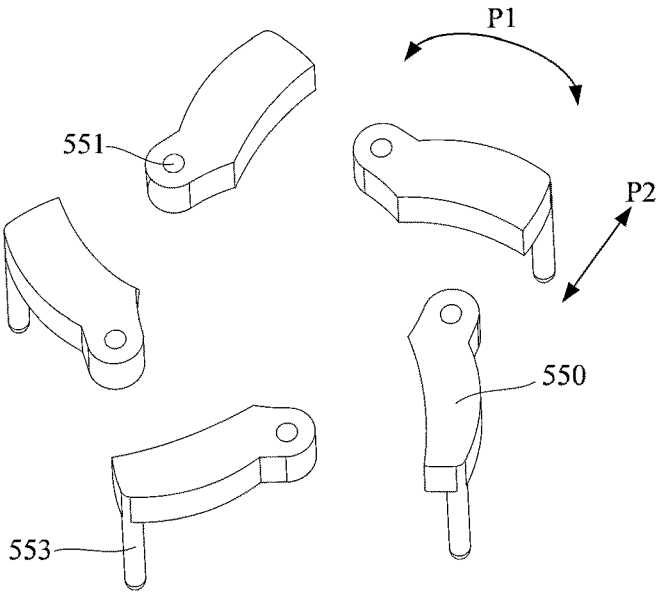
FIG. 13 is a schematic view of the spacer of FIG. 12 in a state of releasing the smokable material.
Figure 14:
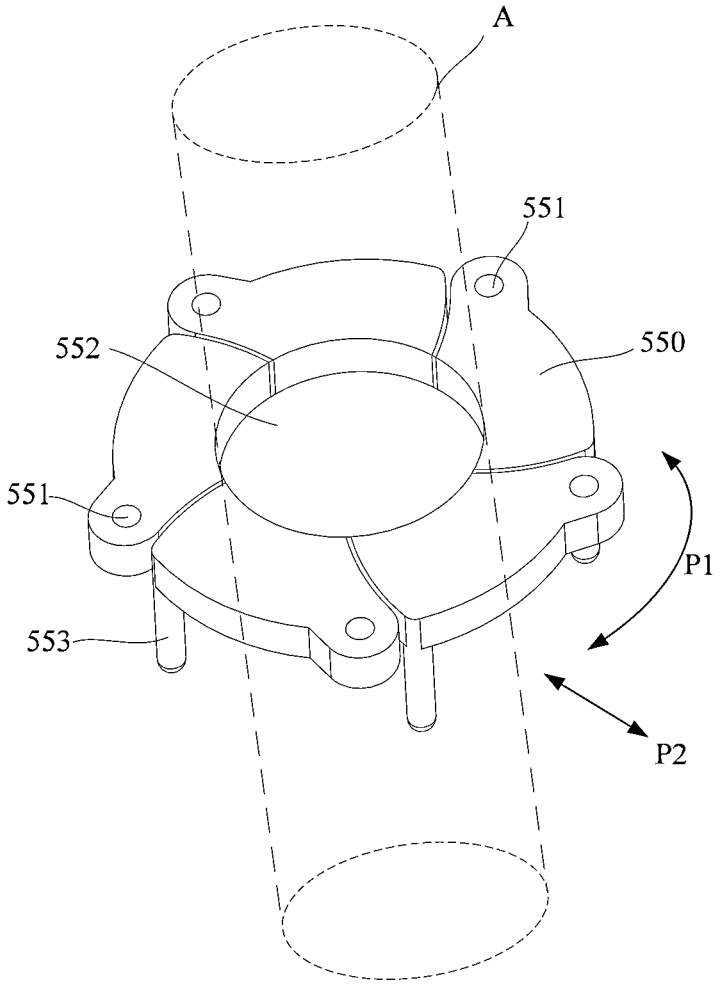
FIG. 14 is a schematic view of the spacer of FIG. 13 in a state of moving to abut against the smokable material.

In the embodiment shown in FIG. 12 to FIG. 14, there are five spacers 550, which are arranged around the central axis of the tubular heating element 510 in sequence to form a surrounding space 552 located at the center of the spacers 550, and the smokable material A is received into the accommodating cavity 511 after passing through the surrounding space 552.

Further, the actuating mode of the movement of the at least one spacer 550 and related functional components described above comprise: a knob 540 for actuating, capable of rotating around the central axis of the tubular heating element 510; the spacer 550, hinged with the knob 540 through a hinge part 551; specifically, in FIG. 12, the hinge part 551 is in the form of a hole which may be fitted and assembled with a corresponding columnar pin 541 on the knob 540 so as to rotate with each other; therefore, when the knob 540 rotates itself, it can drive the spacer 550 to rotate together, and the movement trend driven by the knob 540 may be shown by an arrow P1 in FIG. 13 and FIG. 14; a guide bracket 530, fixed in the housing of the aerosol generating device; the guide bracket 530 is provided thereon with a guide groove 531, and the extension direction of the guide groove 531 is biased towards or away from the central axis from the circumferential rotation direction of the knob 540; while the corresponding spacer 550 is provided thereon with a guide stud 553 which extends into the guide groove 531 to match with the guide groove 531, so that when driven by the rotation of the knob 540, the spacer 550 can rotate towards or away from the central axis relative to the knob 540 with the hinge part 551 as the axis under the guidance of the guide groove 531, as shown by an arrow P2 in FIG. 13 and FIG. 14. Therefore, the spacer 550 can expand or collapse the surrounding space 552 under the actuation of the knob 540, thereby changing the state where the spacer 550 abuts against or releases the outer sidewall of the smokable material A, as shown in FIG. 13 and FIG. 14 respectively. FIG. 13 is a schematic view illustrating the state of releasing the abutment with the smokable material A; and FIG. 14 is a schematic view illustrating the state where the spacer 550 abuts against the outer sidewall of the smokable material A when moving to the collapsed position.

By adopting the aerosol generating device of the above embodiment, the gelatinized substances in the gap between the smokable material and the heating tube can be prevented from escaping outside the housing or entering the smokable material when the user smokes, thereby ensuring a good smoking taste.

It shall be noted that, embodiments of the present application are given in the specification and attached drawings of the present application. However, the present application can be realized in many different forms, and it is not limited to the embodiments described in this specification. These embodiments do not serve as additional restrictions on the content of the present application, but are provided for a more thorough and comprehensive understanding of the disclosure of the present application. Moreover, the above-mentioned technical features continue to be combined with each other to form various embodiments not listed above, which are regarded as within the scope recorded in the specification of the present application. Furthermore, it is possible for those skilled in the art to make improvements or alterations according to the above description, and all these improvements and alterations should be within the scope claimed in the appended claims of the present application.

What is claimed is:

1. An aerosol generating device, configured to heat a smokable material to volatilize at least one component of the smokable material, and comprising:

a heating element, being a tubular shape and comprising a hollow central portion forming a chamber for receiving the smokable material, wherein the heating element surrounds the chamber such that the heating element is configured to circumferentially heat the smokable material received in the chamber; and at least one spacer, at least partially extending into the chamber when the smokable material is received in the chamber, wherein the spacer comprises a first spacer and a second spacer;

the first spacer and the second spacer are arranged at intervals in an axis direction of the chamber; and the first spacer and the second spacer are configured to abut against the outer sidewall of the smokable material and a hollow spacing space is formed between the heating element, the first spacer, the second spacer and the outer sidewall of the smokable material, when the smokable material is received in the chamber.

2. The aerosol generating device according to claim 1, wherein the spacer comprises a blocking part which at least partially extends into the chamber and is able to abut against the outer sidewall of the smokable material.

3. The aerosol generating device according to claim 2, wherein the blocking part is provided thereon with a strength reduction structure, so that the blocking part has deformation capacity to reduce the friction force with the outer sidewall of the smokable material.

4. The aerosol generating device according to claim 3, wherein the strength reduction structure comprises a notch or slit extending along a radial direction of the chamber.

5. The aerosol generating device according to claim 4, wherein a width of the notch or slit is from 0.05 mm to 1 mm.

6. The aerosol generating device according to claim 1, wherein the heating element further comprises a first end and a second end opposite to each other;

the first spacer is configured to prevent the air in the spacing space from leaving the chamber through the first end;

the second spacer is configured to prevent the air in the spacing space from leaving the chamber through the second end.

7. The aerosol generating device according to claim 6, wherein the heating element is a resistance heater or is configured to heat by penetration of a changing magnetic field.

8. The aerosol generating device according to claim 1, wherein the chamber comprises a proximal end and a distal end opposite to each other, and an opening at the proximal end; in use, the smokable material is removably received in the chamber through the opening;

the first spacer is disposed adjacent to the proximal end, and the second spacer is disposed adjacent to the distal end.

9. The aerosol generating device according to claim 1, wherein the spacer is ring-shaped.

10. The aerosol generating device according to claim 1, wherein the spacer is able to be configured between a first configuration and a different second configuration; wherein, in the first configuration, the spacer at least partially extends into the chamber and abuts against the outer sidewall of the smokable material received in the chamber, thereby closing the spacing space to prevent the air in the spacing space from escaping from the chamber by the first spacer, and to prevent the air in the spacing space from entering the smokable material through an end of the smokable material received in the chamber by the second spacer; and in the second configuration, the spacer releases abutment with the outer sidewall of the smokable material.

11. The aerosol generating device according to claim 1, wherein the heating element comprises a heating pipe that provides the hollow central portion forming the chamber;

the heating pipe comprises a first end and a second end upstream from the first end; and the second end is configured to allow air into the smokable material, when the smokable material is received in the chamber.

12. The aerosol generating device according to claim 11, further comprising an outer housing having a proximal end and a distal end opposite to each other, wherein the distal end of the outer housing is provided with an air inlet opposite to the second end;

the air inlet is disposed opposite to a middle region of the second end such that when the smokable material is received in the chamber, the air inlet covers a central portion of an end of the smokable material.

13. The aerosol generating device according to claim 11, wherein the heating pipe is made of conductive materials.

14. The aerosol generating device according to claim 11, the heating pipe is configured to be a resistance heater.

15. The aerosol generating device according to claim 11, the heating pipe is configured to be a tubular susceptor.

* * * * *